US005768877A

United States Patent [19]

Morhenne

[11] Patent Number: 5,768,877

[45] Date of Patent: Jun. 23, 1998

[54] HEATING DEVICE WITH EXCHANGEABLE YARN GUIDE INSERT

[75] Inventor: Siegfried Morhenne, Breckerfeld, Germany

[73] Assignee: Barmag AG, Remscheid, Germany

[21] Appl. No.: 832,545

[22] Filed: Apr. 3, 1997

[30] Foreign Application Priority Data

Apr. 3, 1996 [DE] Germany ..... 196 13 378.5

[51] Int. Cl.[6] ..... D01H 13/28; D01H 57/00

[52] U.S. Cl. ..... 57/290; 57/352; 219/388; 28/249; 28/258

[58] Field of Search ..... 57/290, 284, 352; 219/388; 28/240, 249, 258

[56] References Cited

U.S. PATENT DOCUMENTS

| | | | |
|---|---|---|---|
| 5,148,666 | 9/1992 | Bauer et al. | 57/290 |
| 5,605,644 | 2/1997 | Morhenne | 57/284 X |
| 5,628,175 | 5/1997 | Fischer | 57/290 |
| 5,628,176 | 5/1997 | Morhenne et al. | 57/290 |
| 5,666,797 | 9/1997 | Bruske et al. | 57/290 |

FOREIGN PATENT DOCUMENTS 44 23 202 1/1995 Germany .

*Primary Examiner*—Daniel P. Stodola
*Assistant Examiner*—Tina R. Taylor
*Attorney, Agent, or Firm*—Bell Seltzer Intellectual Property Law Group of Alston & Bird LLP

[57] ABSTRACT

A yarn heating apparatus for use in a yarn false twisting machine, which has a heated axial channel in which the yarn advances along a zigzagged path. To guide the yarn in the axial channel, yarn guides are provided, which are mounted to a generally U-shaped sheet metal rail which is removably received in the axial channel. The U-shaped rail has a base and side strips which lie flat against the bottom wall and side walls of the channel, and the yarn guides are mounted to a rail by holding elements which include an opening in the rail and a projection on the yarn guides which extend through the opening so as to engage the wall of the channel. The yarn guides may be fabricated from a ceramic material, or include a ceramic coating.

16 Claims, 6 Drawing Sheets

HEATING DEVICE WITH EXCHANGEABLE YARN GUIDE INSERT

BACKGROUND OF THE INVENTION

The invention relates to a heating device for heating an advancing synthetic filament yarn and which is particularly adapted for use in a yarn false twist crimping machine.

In the conventional process of crimping synthetic filaments yarns in a false twist crimping machine, the yarn advances in a heated channel, and yarn guides are arranged in the channel such that the yarn is spaced from both the bottom wall and from the side walls of the channel. Heat is supplied from a heater which surrounds the channel. Such a heating device may also comprise a plurality of channels, with each channel accommodating one yarn.

In the channel, the yarn guides are preferably arranged such that they guide the yarn along a zigzagged line, in the manner disclosed for example in EP 0 412 429 A2 and corresponding U.S. Pat. No. 5,148,666.

For the described purpose, the known heating devices are operated at temperatures substantially higher than 300° C. At these temperatures, a portion of the organic compounds is evaporated, whereas residual anorganic compounds accumulate on the yarn guides. These sediments result from the contact of the advancing yarn with the surface of each yarn guide, and they may accumulate over time. When sediments have reached a certain size or height, it can no longer be ensured that the yarn advances along the optimized path which it is urged to follow. However, the optimal yarn path which is defined in the heater has a decisive influence on the quality of the yarn.

Since in modern false twist machines very high yarn speeds are realized, there arises not only the problem with sediments on the yarn guides, but also the problem of mechanical wear in the course of the operating time of the heating device. Likewise, an increasing wear results in that the yarn no longer follows the optimized yarn path in the heating device and this can also affect the quality of the yarn.

Both sediments and mechanical wear of the yarn guides make it necessary that the yarn guides be exchanged at certain intervals in the operation of the heating device, or that even the complete heater be replaced.

DE 44 23 202 A1 also discloses a heating device for heating an advancing yarn, in which the yarn is guided by means of a plurality of yarn guides in a channel along a zigzagged line. In this device, the channel is arranged in a heater, and the yarn guides are inserted and held in a bent, resilient sheet metal support that is inserted into the channel. The yarn guides have substantially the shape of a plate and they are inserted from the outside in such a support, and they possess a resilient base. Once the support is inserted in the channel, these bases are pushed by the support so that their ends abut against the inside surface of the side walls of the channel in the heating device.

Such a construction with a sheet metal support and the yarns guides inserted into the support, has the advantage that it is no longer necessary to exchange the entire heating device in the case of wear or sediments forming on the yarn guides, since the individual yarn guides are exchangeable, after removing the support from the channel of the heating device. However, since the support does not lie directly against the inside walls of the channel in the heater, the heat transfer from the actual heater of the heating device to the yarn guides and, thus, to the yarn is not optimal. In addition, under the described operating conditions of high yarn speeds and with the conventional materials used for the yarn guides, the yarn guides wear down relatively quickly and are subjected likewise to a relatively high tendency of sediments from the yarn being deposited on the yarn guides.

It is accordingly the object of the invention to provide a heating device for an advancing synthetic filament yarn, whose yarn guides exhibit improved properties, in particular with respect to service life, exchangeability, and resistance to wear, and which ensure a good heat transfer from the actual heater to the yarn.

SUMMARY OF THE INVENTION

The above and other objects and advantages of the present invention are achieved by the provision of a yarn heating apparatus which comprises an elongate heater body which has a channel therein which extends in an axial direction along the length thereof, with the channel is of generally rectangular cross section and defines parallel opposite side walls and a bottom wall. Means are provided for heating the heater body, and yarn guide means is disposed in the channel for guiding the advancing yarn axially along the channel in a laterally zigzagged path of travel. The yarn guide means comprises a generally U-shaped rail which defines a base and opposite side strips, and the rail is disposed in the channel so that the base of the rail lies flat against the bottom wall of the groove and the side strips of the rail lie flat against respective ones of the side walls of the channel. A plurality of axially spaced apart yarn guides are secured to the rail so as to be disposed within the channel, and the yarn guides are configured for guiding the advancing yarn axially along the channel in a laterally zigzagged path of travel.

In the heating apparatus of the present invention, the yarn being heated advances along a line deviating from a straight line, at a distance from the side walls and the bottom wall of the channel, and so as to follow a yarn path which is optimized, in particular with respect to heating time, heating intensity, and friction to which the yarn is exposed.

In accordance with the invention, the yarn guides preferably consist of ceramic, or they have a ceramic coating, and they are secured in position in the channel by holding elements which interlock the yarn guides with the rail. The holding elements are designed and constructed such that the rail lies substantially flat against the bottom wall and side walls of the channel, and so that the yarn guides are held in the desired position. By arranging the rail in the channel flush with the walls thereof, a good heat transfer exists from the heater containing the channel. Preferably, heating elements known per se are embedded in the heater.

The yarn guides are held by the cooperating holding elements in the rail and, thus, in the channel, in such a manner that they are substantially free of tension, inasmuch as, according the invention, the yarn guides consist of ceramic. Ceramic exhibits a high resistance to wear, which results in a long service life of the yarn guides. In addition, ceramic has been found to process the property of reducing the tendency to accumulate sediments of anorganic components from the yarn, as compared to conventional yarn guides made of steel.

In a preferred embodiment of the invention, the holding elements are formed as openings in the base of the rail and/or in the region of at least one of the side strips of the rail and which is spaced from the channel bottom wall. In these openings, the yarn guides engage with respectively at least one correspondingly shaped projection.

In a further, preferred embodiment, the openings in the rail are designed for such an engagement with the correspondingly shaped projections of the yarn guides, so that after inserting the rail into the channel, the yarn guides cannot be removed separately from the channel. This means that the yarn guides can be removed from the heating device only together with the rail holding the yarn guides. In this manner, the yarn guides are held both flush with the inside wall of the channel in the heating device and secured in their position. Especially preferred, because of their simple geometric structure, are, for example, circular openings in the rail and corresponding circular projections on the portion of the yarn guides which are directed respectively toward the channel side walls and bottom wall. The diameter of the openings formed in the rail corresponds to the diameter of the projections provided in the yarn guides. Thus, after inserting the yarn guides into the rail and after inserting the rail holding the yarn guides into the channel of the heating device, the yarn guides are secured in their position such that, even when the advancing yarn advances thereover, any movement of the yarn guides is prevented.

In yet another preferred embodiment, the holding elements include at least one resilient pressing element, which holds the yarn guides on the channel side walls in the region of the bottom wall, on at least one side strip of the rail. These resilient pressing elements are constructed such that they ensure, preferably in formfitting manner, a cooperation between the rail and yarn guides.

Preferably, the resilent pressing elements are designed and constructed as recesses having the shape of a spherical segment or cup in the yarn guide. These recesses are provided in the region of the channel bottom wall, and receive, by deformation thereinto, the adjacent portion of the side strip of the rail. This formfitting connection, which may also be combined with frictional engagement, without causing tensions that are hazardous to the ceramic yarn guides, has the advantage that the yarn guides are held exactly in the desired position within the channel of the heater.

A yet further preferred embodiment provides, in addition to the cup-shaped recess in the region of the yarn guide facing the channel side wall, a further cup-shaped recess in the region of the yarn guide facing the opposite channel side wall. Formed into this further recess, likewise of cup shape, is the adjacent portion of the rail. The provision of holding elements in at least two planes of the yarn guides ensures that same are safely and reliably secured in position.

In this connection, it is especially advantageous to have the opposing recesses offset from one another. This allows a pitching moment on the yarn guide to be generated after deforming the rail, so that one shoulder of the yarn guide is held on one of the side strips of the rail.

In the place of the cup-shaped recesses in the yarn guides and the correspondingly shaped protrusions of the rail pressed thereinto, a further preferred embodiment provides for supporting tongues which are formed on at least one of the side strips of the rail and which are formed by corresponding cut-outs in the particular region of the side strip of the rail. After inserting the yarn guides, these tongues can be bent to overlie the outside surfaces of the yarn guides for securing same in position. Preferably, such a tongue in the rail is provided in a region of its side strips which is directed toward the opening of the channel, i.e., in the upper region of the channel, so that the tongues can be placed against or bent over beveled surfaces of each yarn guide.

To ensure that during the operation of the heating device with the yarn advancing therethrough, a displacement of the yarn guides in an axial direction is totally avoided, the rail may be provided with additional tongues, which are arranged in the side strips adjacent the base of the rail, and which can be bent from the plane of the side strip of the rail into the interior of the channel. These tongues thus overlie the sides of the yarn guides so that the yarn guides are secured against movement in the axial direction of the channel. Also these tongues ensure that the yarn guides are secured in position in two planes.

Preferably, the yarn guides are of L-shape, and they lie substantially flat against the surfaces of the rail when it is inserted into the channel. In yet a further preferred embodiment, the yarn guides have rounded guide edges, so as to prevent having the yarn advance over sharp edges in the region of its deflection. The yarn guides may be of boot shape, with the upright leg portion of the boot forming the long side of the L-shape, and the horizontal or instep portion forming the short side of the L-shape. This boot-shaped construction of the yarn guides ensures that the yarn is maintained at a distance respectively from the bottom wall and side walls of the channel.

In a preferred embodiment, the yarn guides arranged in the channel alternate from one side wall to the other, and they are dimensioned such that the yarn advances along a zigzagged line. However, it is also possible that the yarn advances along a totally curved path through the channel of the heater. Moreover, it is possible to arrange respectively at least two successive yarn guides on the same side wall, which alternate with two yarn guides arranged on the opposite side wall.

Preferably, in a yet further preferred embodiment, the channel is made straight in the axial direction of the heating device.

BRIEF DESCRIPTION OF THE DRAWINGS

Further advantages, characteristics, and uses of the present invention are described in more detail with reference to the embodiments of the invention as illustrated in the attached drawings, in which.

BRIEF DESCRIPTION OF THE PREFERRED EMBODIMENTS

Figure 1A:
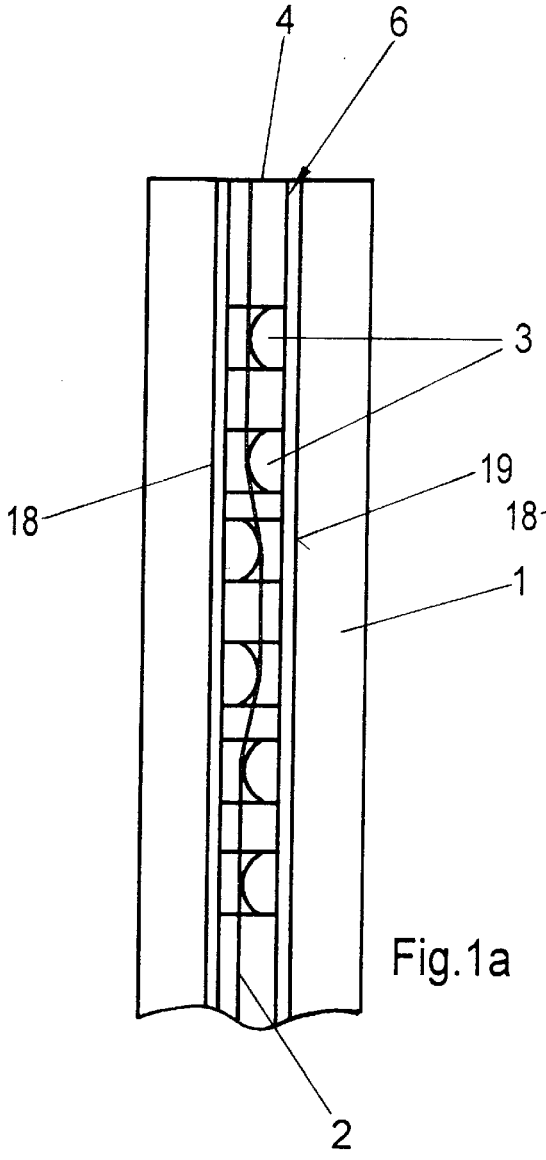
FIG. 1*a* is a top view of a first embodiment of a yarn heating apparatus in accordance with the present invention, and which shows the yarn path of travel.

Shown in FIG. 1*a* is a top view of a yarn heating apparatus 1, which has a straight-line channel 4 formed along the axial length thereof. The channel 4 is of generally rectangular cross section and defines a bottom wall 5 and parallel opposite side walls 18 and 19. In the channel 4, two successive yarn guides 3 arranged on one side wall are provided alternately along the side walls 18 and 19. The yarn guides 3 are mounted on a U-shaped rail 6. As a result of this arrangement, the yarn 2 is forced to follow on its way through the channel along a zipzagged path of travel which includes linear segments which are parallel to the axial direction. In their cross-section, the yarn guides 3 are rounded, so that, when being deflected, the yarn 2 is able to lie pliantly against the rounded surface of the yarn guides and undergoes the least possible friction.

Figure 1B:
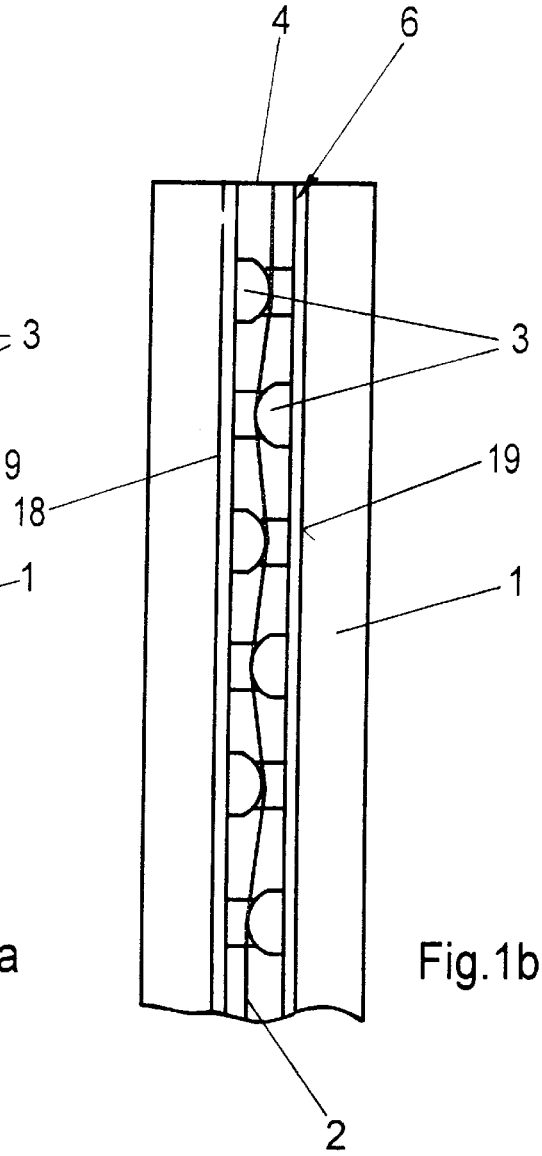
FIG. 1*b* is a top view similar to FIG. 1*a* but showing a second embodiment of the invention.

FIG. 1*b* is likewise a top view of a straight-line channel 4 extending along the heating apparatus 1. This embodiment includes a rail 6, which mounts yarn guides 3 which are alternately positioned on adjacent opposite side walls 18, 19, so that the yarn 2 describes a zigzagged path of travel through the channel 4 of apparatus 1. At the same yarn speeds, a zigzagged yarn path guarantees a longer dwelling time of the yarn in the heating apparatus. However, based on the higher number of deflections and a therewith connected greater contact length of the yarn, the yarn is subjected on a particular yarn guide to greater frictional resistance. Which of the described yarn paths is provided, depends, among other things, on the speed of the advancing yarn, on the heating intensity in the heater, on the material of the yarn, on the spacing between yarn guides along the groove, etc.

Figure 2:
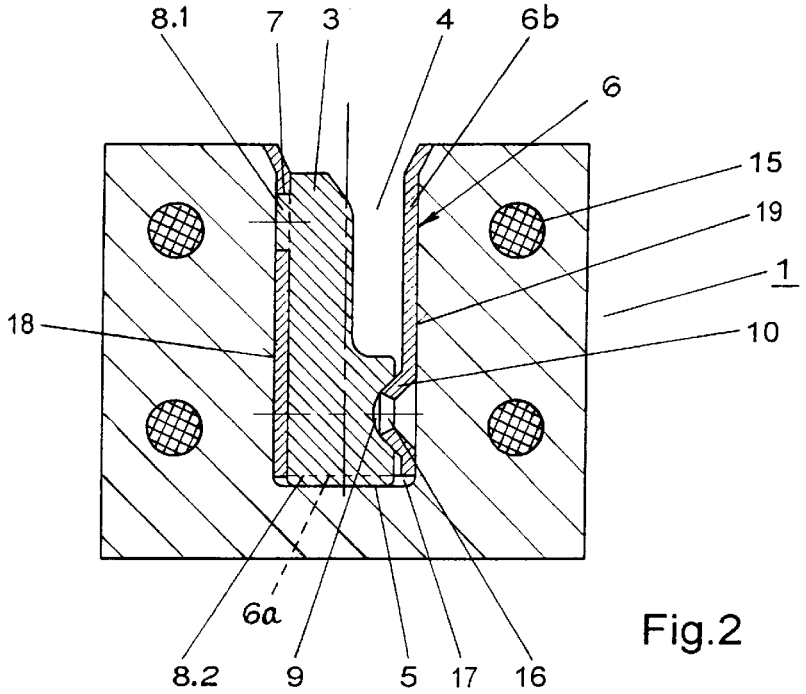
FIG. 2 is a sectional view of the heating apparatus, taken perpendicular to the direction of the advancing yarn, and illustrating holding elements according to one embodiment of the invention.

FIG. 2 is a cross sectional view of a heating apparatus in accordance with the invention taken in a direction perpendicular to the direction of the advancing yarn. The yarn itself is not shown. The heating apparatus includes heating elements 15 which are embedded therein, and since the material of the heater is a good heat conductor, the heat released by heating elements 15 is conducted easily and with little loss to the side walls 18 and 19 as well as to the bottom wall 5 of the channel. Inserted into the channel 4 is the rail 6, which has a U-shape which conforms with the rectangular cross sectional shape of the U-shaped channel. The rail comprises a profiled sheet of metallic material, and it defines a base 6a which lies flat against the channel bottom wall 5, and opposite side strips 6*b* which lie flat against the side walls 18, 19 of the channel. The yarn guides 3 are secured in position inside the rail 6 when it is inserted into groove 4, by means of holding elements 8.1, 8.2 9, 10.

In the region of the side strip 6*b* of the rail 6 adjacent the channel upper opening, circular openings 7 are provided, which are engaged by likewise circular projections 8.1 having the same diameter and extending from the yarn guide 3. Also, the base 6*a* of the rail is provided with substantially rectangular openings 17, in which the yarn guides 3 engage with correspondingly shaped projections 8.2, so that the yarn guides 3 lie directly flat against the bottom wall 5 and are likewise held in the rectangular openings of rail 6 on the bottom wall 5. Furthermore, in the front side of the small shoulder of the L-shaped yarn guide 3, which faces the side wall 19 in its lower region, a recess 9 is formed in the shape of a spherical segment or cup. Deformed into this recess 9 is a portion of the side strip of the rail 6, which also has the shape of a spherical segment or cup, for engagement therewith in the form of a holding element 10. When not inserted into the channel 4, the side strips of the rail 6 are outwardly directed so as to provide a substantially trapezoidal cross section. As a result, the side strips are resiliently deflected toward each other when the rail is inserted in the channel, so that the cup shape constitutes a resilient holding element 10. Thus, as a result of the cooperation of the projections 8 and openings 7 and 17, both on the side strips and base of rail 6, as well as by the cup-shaped, resilient holding element 10, each yarn guide 3 is secured in position in the channel of the heating apparatus 1. It will also be noted that when the rail 6 is assembled in the channel 4, the projections 8.1, 8.2 of the yarn guides rest directly against the bottom wall 5 and side wall 18 of the channel, respectively.

Figure 3:
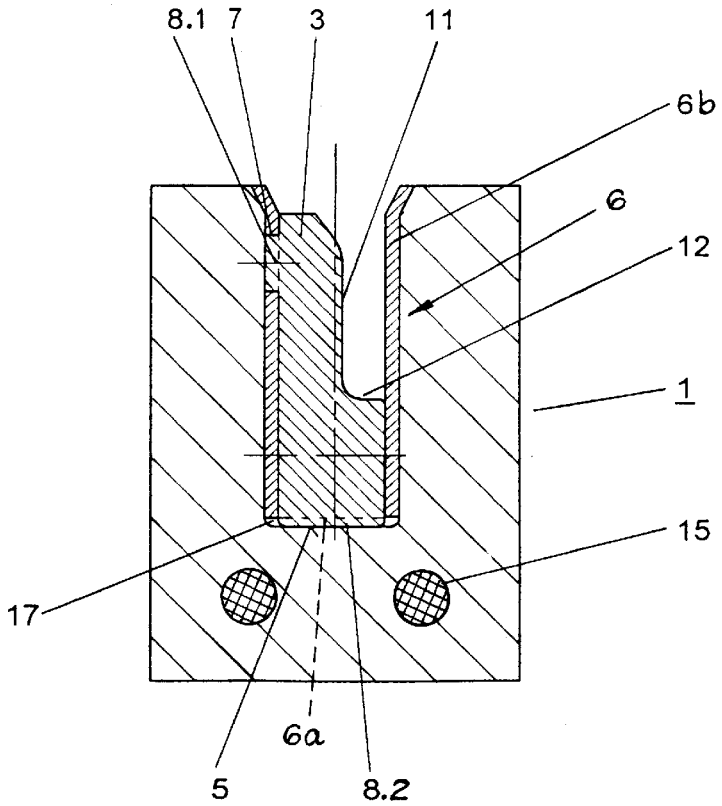
FIG. 3 is a sectional view similar to FIG. 2, but illustrating holding elements according to another embodiment of the invention.

FIG. 3 is a cross sectional view taken perpendicular to the direction of the advancing yarn of a further embodiment in accordance with the invention. In this embodiment, the apparatus 1 comprises two heating elements 15 in the region of the channel bottom wall 5. The rail 6 which is inserted into the channel 4 accommodates the yarn guides 3. As in respect to the embodiment of FIG. 2, these yarn guides are constructed likewise in the shape of a boot with an upright leg portion 11 and a horizontal instep portion 12. In the region of the side strips of the rail 6, and adjacent the upper edge of the channel 4, circular openings 7 are provided, which are engaged by projections 8.1 having the same dimension and a correspondingly circular shape and which are formed on the yarn guides 3. Thus, each yarn guide 3 is secured in position by the holding elements in two planes, namely, on the one hand in the upper region of channel 4 by the holding elements comprising the circular projection 8.1 engaging into the circular opening 7 in the side strip of the rail 6, and on the other hand at the bottom by correspondingly shaped projections 8.2 of yarn guides 3 engaging into the opening 17 of rail 6. In addition, the yarn guide 3 is inserted with its shoulders in formfitting manner between the side strips of rail 6.

Figure 4:
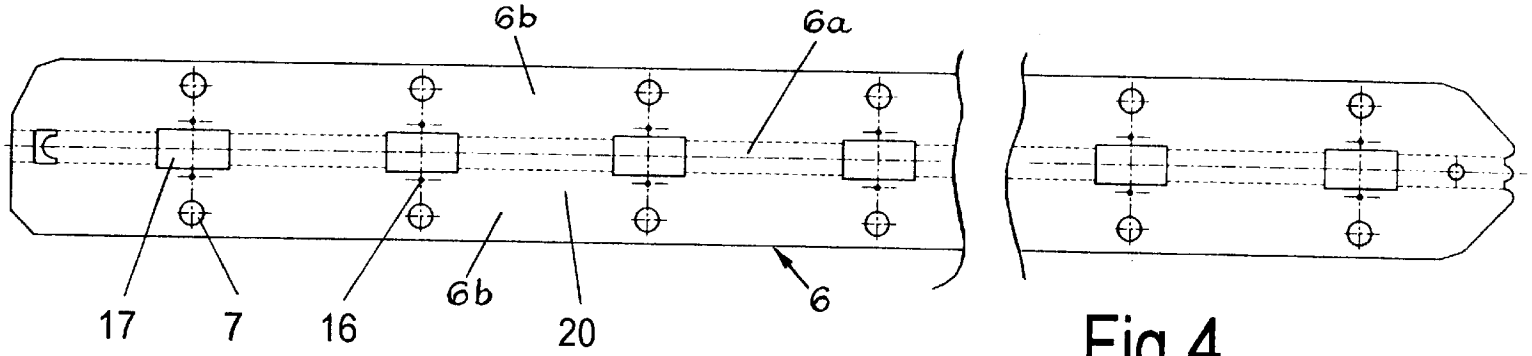
FIG. 4 is a top view of a rail according to the invention, prior to its being folded into a U-shape.
Figure 5:
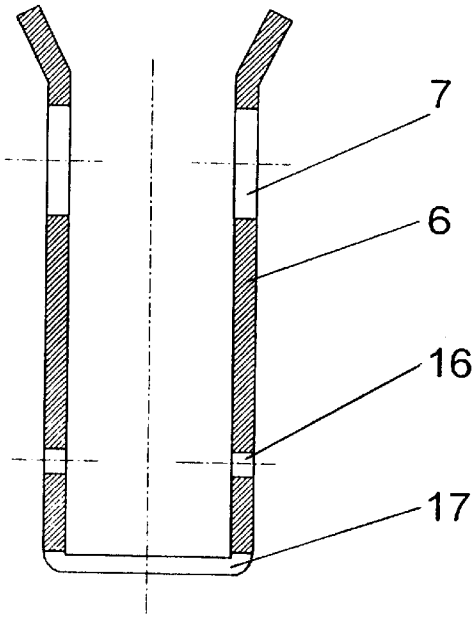
FIG. 5 is an enlarged cross sectional view of a rail which has been formed into a U-shape.

Shown in FIG. 4 is a top view of a metal sheet blank 20, from which the profile of the rail 6 as seen in FIG. 5 is produced by deformation. In FIG. 4, the fold lines are shown by dashed lines. In the region of the metal sheet 20, which forms the base 6*a* after deformation, rectangular openings 17 are provided, which are intended to receive correspondingly shaped projections of that portion of the yarn guides 3. On the side of these rectangular openings 17, circular openings 7 are provided, which are engaged by projections 8.1 arranged on the portion of yarn guides 3 which forms the long upright leg of the L-shape.

Moreover, in the region between openings 7 and rectangular openings 17, additional holes 16 are provided, which are intended for receiving a tool, which is provided to form the cup shape into the side strip of the rail for engagement into a corresponding recess 9 provided in the lower front end region of the small shoulder of the L-shaped yarn guides 3. These holes 16 are provided in rail 6, so that same can be used for securing yarn guides 3 in groove 4, both with only the projections 8.1 engaging into the correspondingly shaped openings 7 and with the cup-shaped holding elements 9, 10 that are provided in addition.

Illustrated in FIG. 5 is an enlarged cross sectional view of the rail 6, which shows the rail in its inserted condition in channel 4 after having been bent to the shape of the channel. In its outer contour, the rail 6 has the shape of the channel 4. In the upper region of the channel, the side strips 6*b* of the rail are slightly angled outward, so as to be arranged flush with in an angled upper region of the channel in the inserted state. Arranged in the upper region of the side strips of the rail 6 are the circular openings 7, which receive the correspondingly shaped projections 8.1 of the yarn guides. To provide the rail 6 for use in modular manner for any kind of arrangement of the yarn guides 3, each side strip of the rail comprises such an opening 7 at each point in the heating device 1, which is to be provided with a yarn guide 3, i.e., at the interval in which the yarn guides 3 are to be arranged in the heating apparatus 1. In the region facing the bottom wall 5, the respective rectangular openings 17 are arranged at the spacing of the yarn guides 3 between one another. In the region between openings 7 and 17, the strips contain oppositely arranged holes 16, which are needed for applying a tool, in the event that cup-shaped resilient holding elements 10 are also to be formed at that location.

Figure 6:
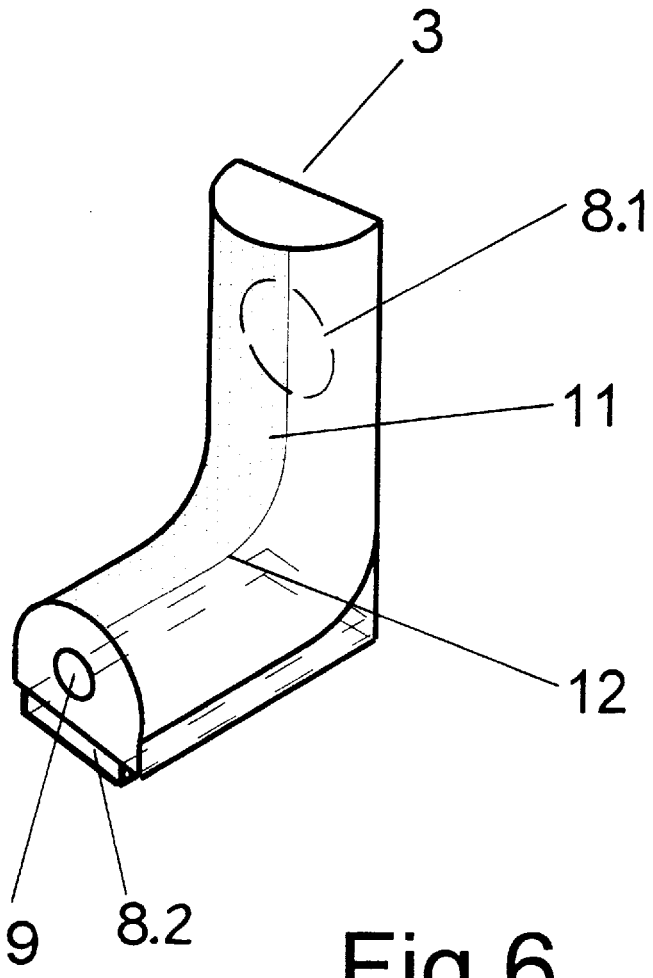
FIG. 6 is a perspective view of an L-shaped yarn guide in accordance with the invention.

FIG. 6 is a perspective view of a yarn guide 3 as is provided for use in the rail 6, with holding elements shaped in accordance with the invention.

The surface of the yarn guide 3 facing the yarn is shown as being rounded, so that the yarn as it advances over yarn guide 3 can be in gentle contact with the surface of same. The yarn guide is made L-shaped, so that it possesses the shape of a boot. The boot shape of yarn guide 3 is formed by an upright leg portion 11 and a horizontal instep portion 12. On its large shoulder of the L-shape, the yarn guide is provided with a projection 8.1 of a circular cross section, which is shown in dashed lines. On the underside of the yarn guide 3, a further projection 8.2 is formed. On the front side of the small shoulder of the L-shape, which faces the side wall in the lower region of the channel, the yarn guide 3 possesses a cup-shaped recess 9. The remaining surface of yarn guide 3 which faces the rail 6 in its inserted state is made flat, so that the yarn guide lies flat against the regions provided between openings 7, 17 of the rail 6.

Figure 7:
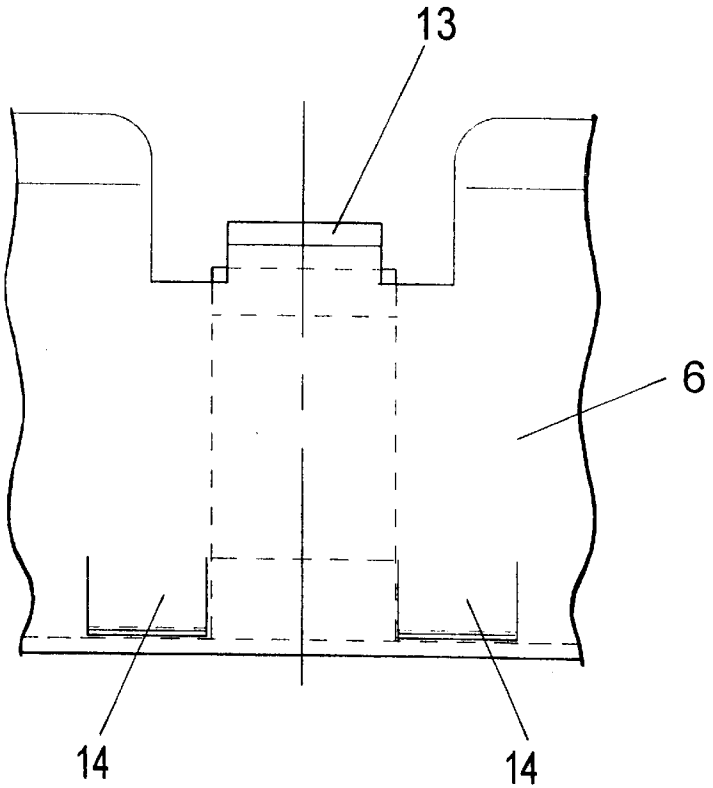
FIG. 7 is a fragmentary side view of a rail with inserted yarn guides and with tongues used as holding elements.

FIG. 7 shows a further embodiment of mounting the yarns guides 3 in rail 6 with holding elements made in the form of tongues 13, 14. In the upper region of the channel 4, the side strips of rail 6 are provided with cut-outs, between which a bendable tongue 13 is formed. In the inserted state of yarn guides 3 and the rail 6 in the channel 4, the respective tongues 13 are bent such that they lie against the obliquely shaped upper side of the yarn guides 3 in the manner of a clamp and, thus, constitute a mounting, which is formed by formfitting and frictional engagement. This tongue 13 keeps yarn guide 3, which lies with its corresponding surfaces flat against the inside surfaces of the rail 6, in the respective position inside the channel. To ensure during the operation of the heating device, while the yarn advances at a high speed in the direction of its advance over the yarn guides 3, that the yarn guides are unable to perform a lateral movement in the axial direction of the channel, the rail 6 is also provided, in its region adjacent the bottom wall 5, with cut-outs, between which corresponding, additional tongues 14 are formed. These additional tongues can be bent into the channel 4, so that their lateral edges lie flat against the lateral surfaces of yarn guides 3 on both sides thereof in such a manner that the particular yarn guide is unable to perform any lateral movement in the axial direction of the channel 4, and the guide is thus fixedly secured in its position.

Figure 8:
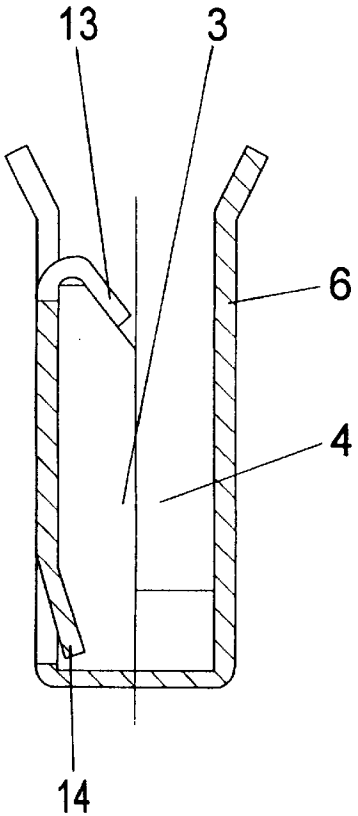
FIG. 8 is a sectional view, taken perpendicular to the direction of the advancing yarn, of an embodiment according to FIG. 7 and in a region of the rail between yarn guides.

FIG. 8 is a sectional view of the embodiment of FIG. 7, in which the rail 6 is sectioned in a region between yarn guides 3, so that it is possible to see both tongue 13 which is folded over the upper side of yarn guide 3, and tongues 14 which are bent over the sides of yarn guide 3 into the channel 4.

Figure 9:
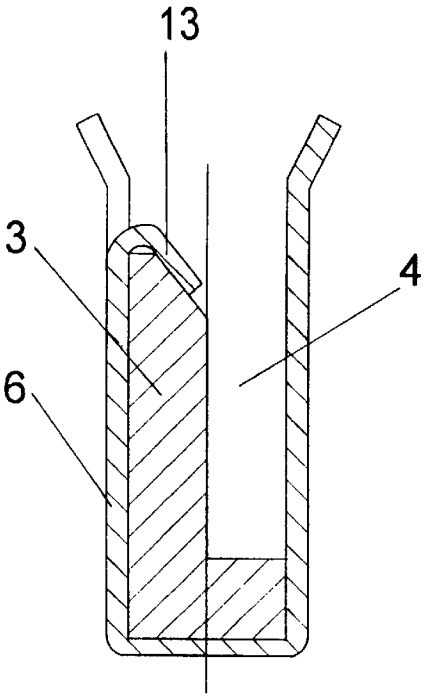
FIG. 9 is a sectional view similar to FIG. 8, but taken through a yarn guide.

FIG. 9 is a sectional view of the embodiment shown in FIG. 7, with the cutting plane extending perpendicular to the direction of the advancing yarn through the yarn guides 3. The yarn guide 3 arranged inside the rail 6 is held in its position by tongue 13, which cooperates with a correspondingly obliquely shaped surface in the upper region of the yarn guide 3.

Figure 10:
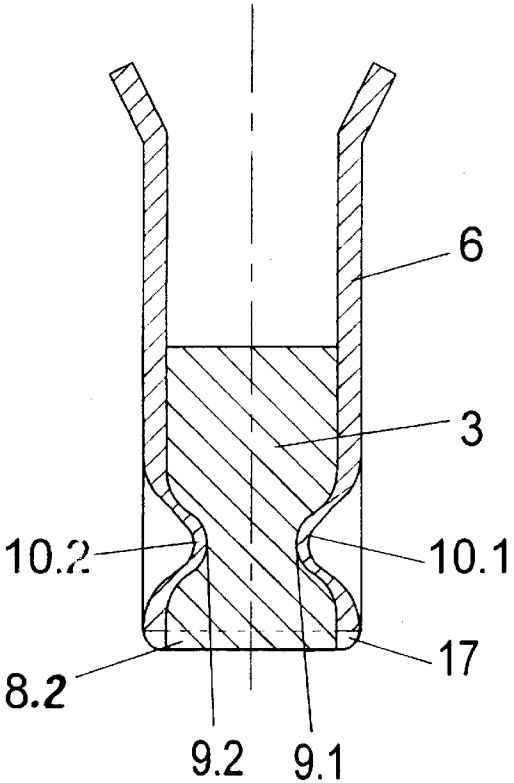
FIG. 10 is a sectional view of a further embodiment of the rail and yarn guides.

FIG. 10 is a sectional view of a further embodiment of a rail 6 with a yarn guide 3 inserted therein. In this embodiment, the yarn guide 3 is made rectangular, so that an advancing yarn is held at a certain level above the bottom wall of the channel. Preferably, such yarn guides are used alternately with the yarn guides described with reference to FIG. 6 in a heating channel for guiding the yarn. On each of its shoulders facing the side strips of rail 6, the yarn guide 3 is provided with a cup-shaped recess 9.1 and 9.2. Into these cup-shaped recesses 9.1 and 9.2 resilient holding elements 10.1 and 10.2 engage, which are produced by deforming the side strip of the rail 6. In its base, the rail 6 has an opening 17, which is engaged by a projection 8.2 of yarn guide 3. Thus, the yarn guide 3 is secured in position by the cooperation of the resilient holding elements 10.1 and 10.2 engaging in recesses 9.1 and 9.2 as well as by projection 8 and opening 17. This arrangement also facilitates the mounting of L-shaped yarn guides. In this case, the recesses 9.1 and 9.2 extend along a plane that is inclined relative to the horizontal. The spacing between the recess in the small shoulder of the yarn guide and the channel bottom wall is greater than the height between the recess of the long shoulder and the bottom wall. As a result, the engagement of the resilient holding elements generates a pitching moment on the yarn guide, so that the long shoulder of the yarn guide is held on the side walls of the rail.

Figure 11:
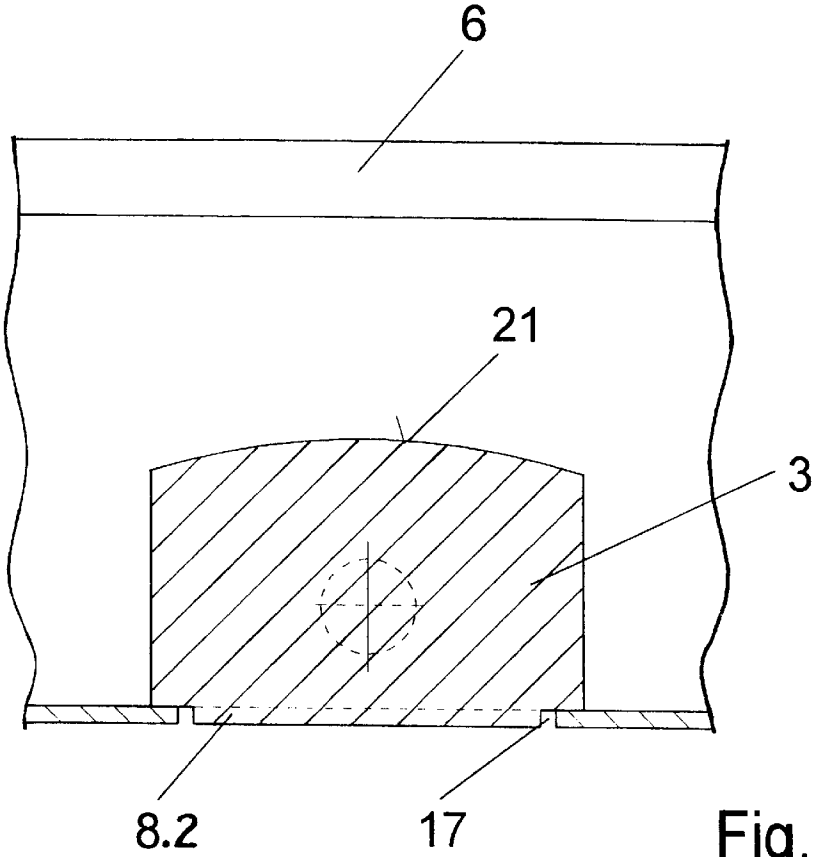
FIG. 11 is a sectional view taken perpendicular to the view of FIG. 10.

FIG. 11 is a lengthwise sectioned view of the rail shown in FIG. 10. In this embodiment, the yarn guide 3 engages with its projection 8.2 in opening 17 of the rail. On its side opposite to projection 8.2, the yarn guide 3 has a curved yarn guide surface 21.

That which is claimed is:

1. An apparatus for heating an advancing yarn comprising an elongate heater body having a channel therein which extends in an axial direction along the length thereof, with the channel being of generally rectangular cross section and defining a bottom wall of a predetermined width and opposite side walls of a predetermined height, means for heating the heater body, and yarn guide means disposed in the channel for guiding the advancing yarn axially along the channel, said yarn guide means comprising a generally U-shaped rail disposed in said channel so as to lie flat directly against substantially the entire width of the bottom wall and substantially the entire height of the side walls of said groove, and a plurality of axially spaced apart yarn guides secured to said rail so as to be disposed within said channel, with the yarn guides being positioned and configured for guiding the advancing yarn axially along the channel in a laterally zigzagged path of travel.

2. The yarn heating apparatus as defined in claim 1 wherein said rail comprises a profiled sheet of material.

3. The yarn heating apparatus as defined in claim 2 wherein each of said yarn guides is secured in said rail by holding means which comprises at least one tongue formed by a bent over portion of said rail and so as to overlie a portion of said yarn guide.

4. The yarn heating apparatus as defined in claim 3 wherein said holding means comprises a first tongue bent over an oblique surface on the yarn guide, and second and third tongues bent into the interior of the rail adjacent said base of said rail and so as to overlie respective sides of the yarn guide.

5. The yarn heating apparatus as defined in claim 2 wherein said rail defines a base which overlies the bottom wall of the channel, and side strips which respectively overlie the side walls of the channel, and wherein the yarn guides each have an L-shape so as to define an upright leg portion and a horizontal leg portion which respectively support the advancing yarn at a distance spaced from the base and the side strips of the rail.

6. The yarn heating apparatus as defined in claim 5 wherein at least some of the yarn guides are alternately arranged on the side strips of the rail so that the advancing yarn is deflected into a zigzagged path of travel by its engagement with the upright leg portions of the yarn guides.

7. The yarn heating apparatus as defined in claim 2 wherein the yarn guides either consist of a ceramic material or comprise a ceramic coating.

8. The yarn heating apparatus as defined in claim 1 wherein each of said yarn guides is secured to said rail by holding means which comprises an opening in said rail and a correspondingly shaped projection on said yarn guide and which is received in said opening.

9. The yarn heating apparatus as defined in claim 8 wherein said rail defines a base and opposite side strips, with said base and side strips being disposed so as to lie flat against the bottom wall and side walls of the channel respectively, and wherein said holding means comprises an opening in said base of said rail and a projection on said yarn guide which is received in said opening and so as to rest against said bottom wall of said channel.

10. The yarn heating apparatus as defined in claim 9 wherein said holding means further comprises a second opening in one of said side strips of said rail, and a second projection on said guide which is received in said second opening and so as to rest against the associated side wall of said channel.

11. The yarn heating apparatus as defined in claim 9 wherein said holding means further comprises at least one recess formed in said yarn guide on a surface facing one of said side strips of said rail, and a deformation in said one side strip which is received in said one recess.

12. The yarn heating apparatus as defined in claim 11 wherein said holding means further comprises a second recess formed in said yarn guide on a surface facing the other of said side strips of said rail, and a deformation in said other side strip which is received in said second recess.

13. An apparatus for heating an advancing yarn comprising an elongate heater body having a channel therein which extends in an axial direction along the length thereof, with the channel being of generally rectangular cross sectional configuration and defining a bottom wall of a predetermined width and opposite side walls of a predetermined height, means for heating the heater body, and yarn guide means disposed in the channel for guiding the advancing yarn axially along the channel, said yarn guide means comprising a sheet metal rail disposed in said channel and having a U-shaped cross sectional configuration which defines a base and opposite side strips, with said base and side strips being disposed so as to lie flat directly against substantially the entire width of the bottom wall and substantially the entire height of the side walls of the channel respectively, and a plurality of axially spaced apart yarn guides secured to said rail so as to be disposed within said channel, with the yarn guides being positioned and configured for guiding the advancing yarn axially along the channel in a laterally zigzagged path of travel, and with the yarn guides either consisting of a ceramic material or comprising a ceramic coating.

14. The yarn heating apparatus as defined in claim 13 wherein said sheet metal rail comprises an integral sheet of metal which is axially folded along a pair of parallel fold lines so as to define said base and side strips.

15. The yarn heating apparatus as defined in claim 14 wherein each of said yarn guides is secured to said rail by at least one holding element which comprises an opening in said rail and a correspondingly shaped projection on said yarn guide and which is received in said opening.

16. The yarn heating apparatus as defined in claim 15 wherein said opening is in said base of said rail and said projection of said yarn guide extends through said opening so as to rest against said bottom wall of said channel.

* * * * *